United States Patent [19]

Schweder

[11] Patent Number: 4,775,315

[45] Date of Patent: Oct. 4, 1988

[54] PROCESS AND APPARATUS FOR REMOVAL OF DEPOSITS AND LININGS FROM HORIZONTAL CYLINDERS

[75] Inventor: Herbert Schweder, Magdeburg, German Democratic Rep.

[73] Assignee: VEB Spezialbaukombinat Magdeburg, Magdeburg, German Democratic Rep.

[21] Appl. No.: 134,543

[22] Filed: Dec. 15, 1987

Related U.S. Application Data

[63] Continuation of Ser. No. 871,507, Jun. 6, 1986, abandoned.

[30] Foreign Application Priority Data

Jun. 6, 1985 [DD] German Democratic Rep. ..... 2771033

[51] Int. Cl.[4] ..... F27D 23/00; B08B 9/08

[52] U.S. Cl. ..... 432/75; 432/2; 15/104.1 C

[58] Field of Search ..... 432/2, 75; 15/104.1 C

[56] References Cited

U.S. PATENT DOCUMENTS

| | | | |
|---|---|---|---|
| 3,848,289 | 11/1974 | Bachmann | 15/104.1 C |
| 3,918,375 | 11/1975 | Hayakawa et al. | 432/75 |
| 3,996,637 | 12/1976 | Shibata et al. | 15/104.1 C |
| 4,102,001 | 7/1978 | Baba et al. | 432/75 |
| 4,229,908 | 10/1980 | Panzeri | 15/104.1 C |

*Primary Examiner*—Henry C. Yuen

*Attorney, Agent, or Firm*—Schweitzer & Cornman

[57] ABSTRACT

A method for the partial or total removal of deposits and/or linings from rotary kilns by introduction of a conically shaped break off roller into the rotary kiln. The break off roller rotates together with the rotating kiln and this results in the roller impacting with its tools onto the interior surface of the kiln to break off parts thereof and to shake and vibrate the interior of the kiln to cause a collapsing thereof. The break off roller has a larger end and a smaller end and elongated guiding means for the disposition and guidance of cutting means and adjustable stabilizing means, and means for breaking and/or reversing the movement of the roller.

7 Claims, 7 Drawing Sheets

PROCESS AND APPARATUS FOR REMOVAL OF DEPOSITS AND LININGS FROM HORIZONTAL CYLINDERS

This is a continuation of Ser. No. 871,507, filed on June 6, 1986, and now abandoned.

The invention relates to a process for the complete or partial removal of deposits and linings in horizontal cylinders which revolve around their longitudinal axis, particularly from a rotary kilns such as those which are used in the cement industry, and to apparatus for carrying out the process.

BACKGROUND OF THE INVENTION

Other than breaking out encrustations and furnace linings by hand, two kinds of methods are known for this purpose. According to one type of method chemicals are used for the removal of the encrustations and deposits. Generally these are not suitable for the removal of the furnace linings in rotary kilns. According to the second type of method, a variety of mechanical approaches can be employed in which rinsing, shaking, blowing, striking, pushing, turning or scraping can be used with or without special drive mechanisms and a variety of different apparatus can be used to break out the deposits and the furnace lining in rotary kilns and then to remove them. For example, German Democratic Republic patent No. 64,844 discloses the principle of a mechanical cleaning apparatus which is additionally actuated with ultrasound. German Federal Republic published patent application No. 271,164 discloses a guided, driven drill rod provided with cutting or scraping means. Other cleaning methods that are known from various technical literature sources have a variety of drawbacks, among them in some cases the complicated method or complicated construction of the apparatus, high cost, difficulty of maintenance, temperature sensitivity, frequent down time and difficulty of operation. Of course, in manual removing methods high labor costs, strenuous nature of the labor that is involved and the frequency of industrial accidents provide substantial disadvantages.

OBJECTIVES OF THE INVENTION

In accordance with the objectives of the present invention, a method and apparatus are provided for the total or partial breaking out of deposits and furnace linings from horizontal cylindrical tubes which are adapted to rotate along their longitudinal axis, particularly in rotary kilns of the cement industry. This should be carried out in a continuous manner either completely or partially without the need for cooling it down, and providing controllable depth and length of removal as well as forward velocity control, with the apparatus having a geometric shape which enables the breaking out of the deposit by itself or together with the furnace lining and the forward velocity of which through the cylindrial tube can be conveniently controlled.

It is to be understood that while in the specification and the claims the invention is explained with respect to rotary kilns, the method and apparatus of the invention is meant to be equally applicable to horizontal or substantially horizontal tubular cylinders which rotate about their longitudinal axis and require the removal of encrustations and/or cylinder linings.

BRIEF SUMMARY OF THE INVENTION

The present invention provides a process for the partial or total removal of deposits and/or linings from rotary kilns by utilizing the rotary motion of the kiln continuously to move a break off or removing roller along the longitudinal axis of the kiln. The device is introduced into the kiln such as by stopping rotation of the kiln, opening the rear of the kiln, liftig the breakoff roller, introducing it to the kiln and then connecting the roller to a winch. The break off roller has a longitudinal axis disposed at an acute angle with respect to the longitudinal axis of the kiln. The moving removing roller exerts continuous striking, shoving and tearing forces against the deposit or the deposit and furnace lining of the kiln resulting in the removal and breaking out of smaller pieces. The continuous removal of smaller pieces and the resulting stress that is created brings about the substantially complete removal of the deposit or of the deposit and the arch structure of the furnace lining which, as a result, will collapse. In a preferred embodiment of the invention, the motion of the break off roller along the longitudinal axis of the rotary kiln can be slowed down, stopped or even reversed by means of a cable pull that is disposed outside of the rotary kiln.

The invention further comprises an apparatus for the removal of deposits from and/or linings of rotary kilns that have a substantially horizontally disposed longitudinal axis, comprising a substantially conical break off roller having a larger end and a smaller end, and further having elongated guiding means for the disposition and guidance of further means thereabout, cutting means for cutting and/or crushing matter to be removed from within the rotary kiln, and disc means disposed about said elongated guiding means for mounting said cutting means from the periphery of said disc means. Suitably the apparatus further comprises stabilizing means disposed at the larger end of said conical removing roller for stabilizing and supporting said break off roller within the rotary kiln, said disc means being disposed on said elongated guiding means off center with respect to the longitudinal axis of the removal roller. The apparatus suitably further comprises means for retarding, stopping and/or reversing the motion in an axial direction of the break off roller.

DESCRIPTION OF THE DRAWINGS

The invention is described with reference being had to the attached drawings in which.

DETAILED DESCRIPTION OF THE INVENTION

In the following the invention is described in greater detail with reference being had to the attached drawing.

Figure 1:
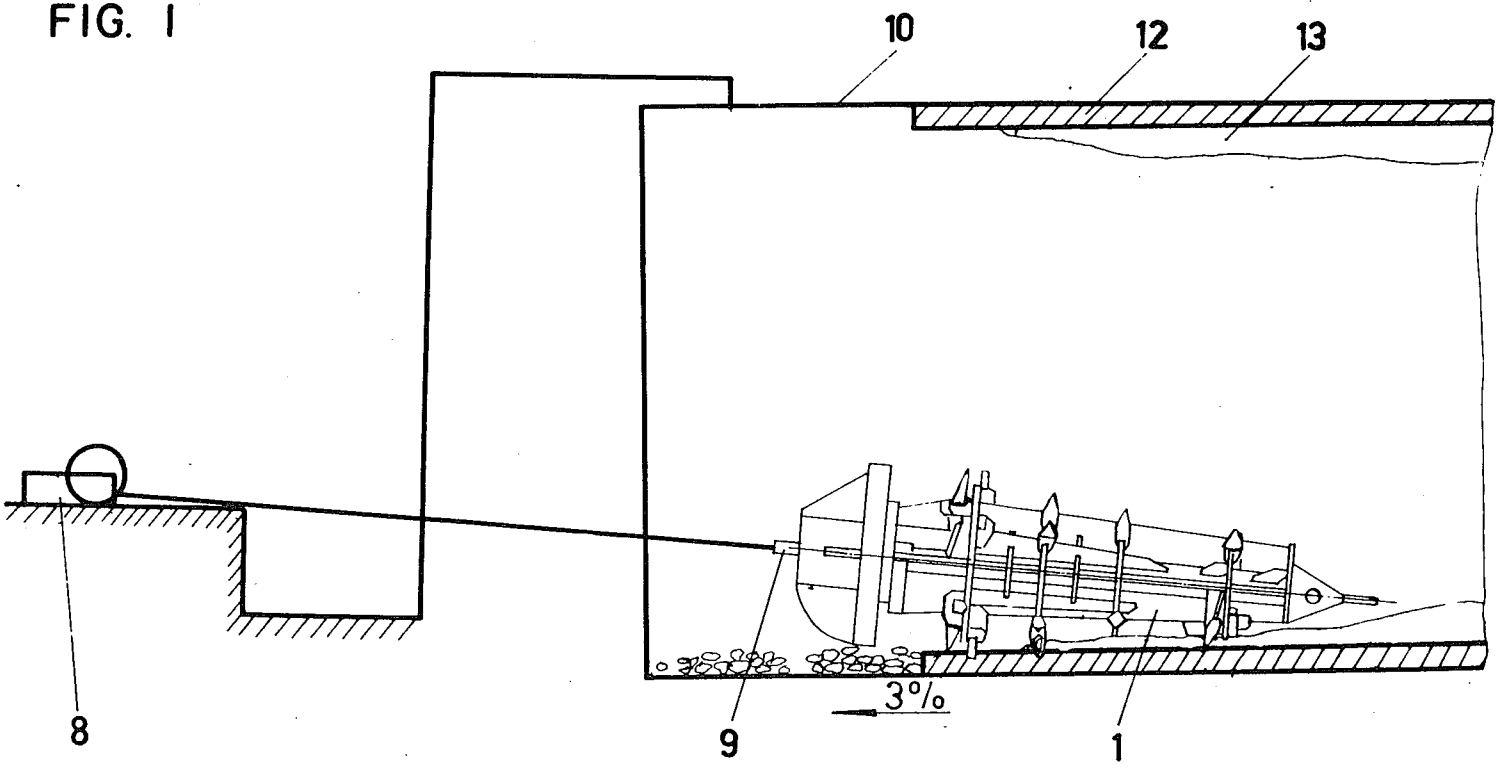
FIG. 1 is a longitudinal cross-sectional view of a rotary kiln schematically showing in elevation the break off roller of the present invention, and a winch.
Figure 2:
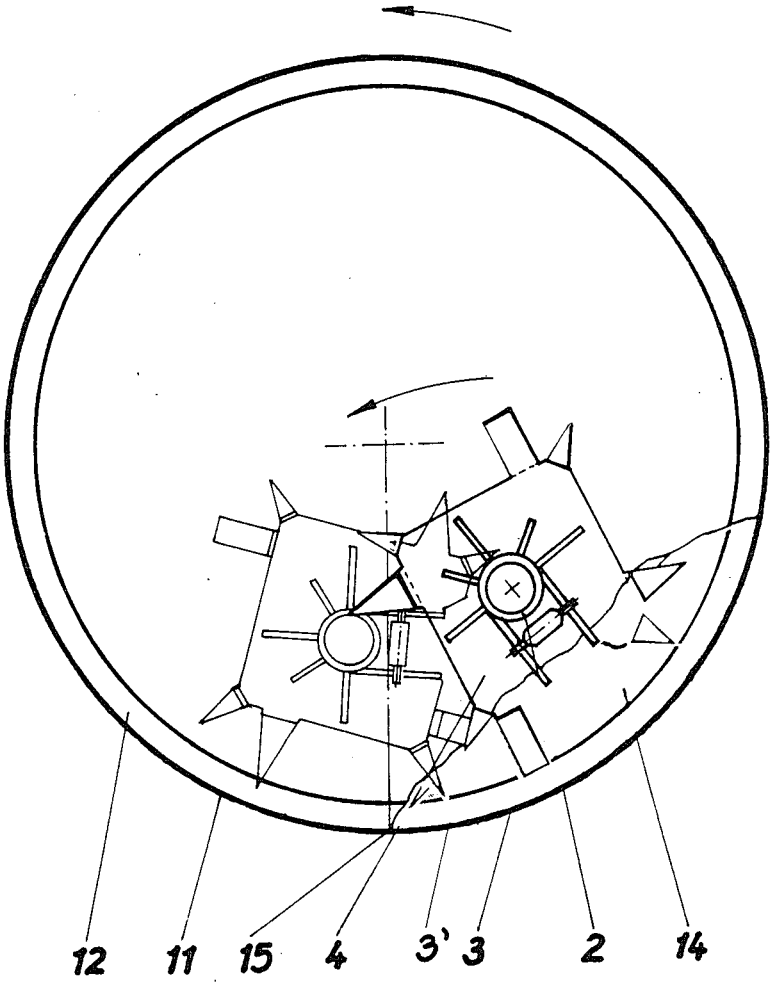
FIG. 2 is a schematic, vertical cross-sectional view of a rotary kiln showing the apparatus of the present invention in one phase of its movement, and without showing the stabilizing disc.
Figure 2A:
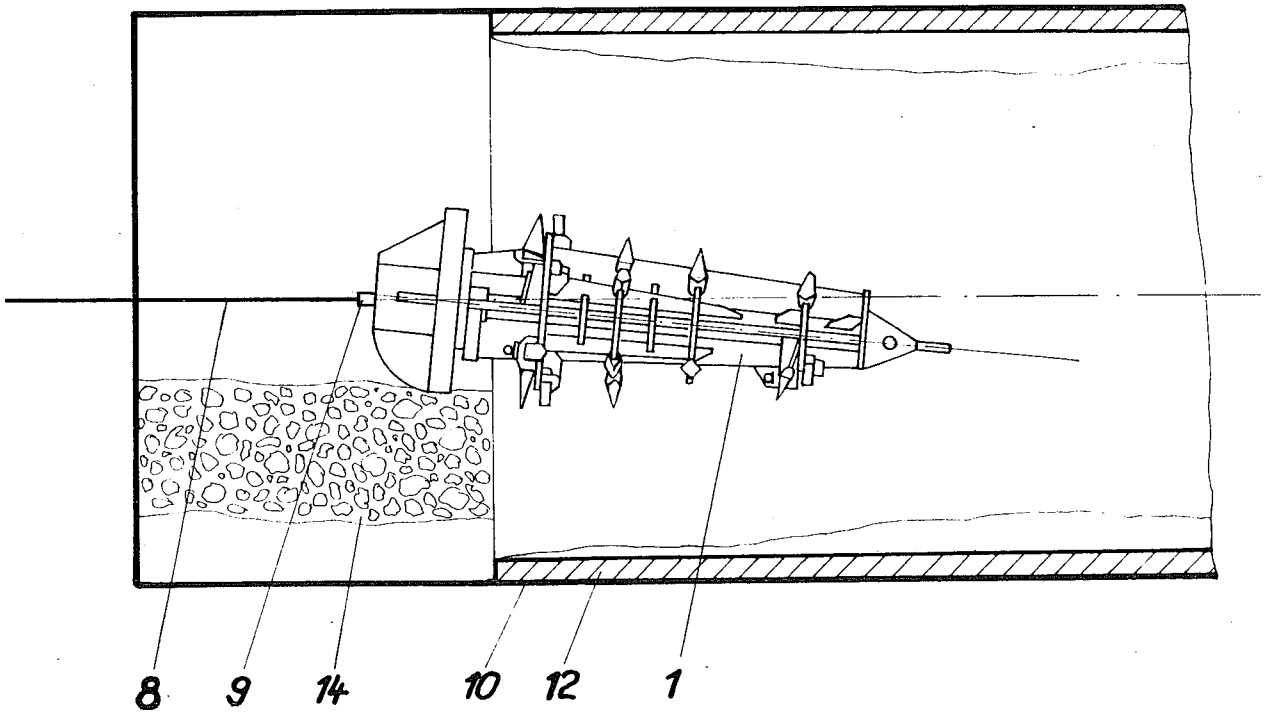
FIG. 2*a* is another schematic cross-sectional view of the same as in FIG. 1.
Figure 3:
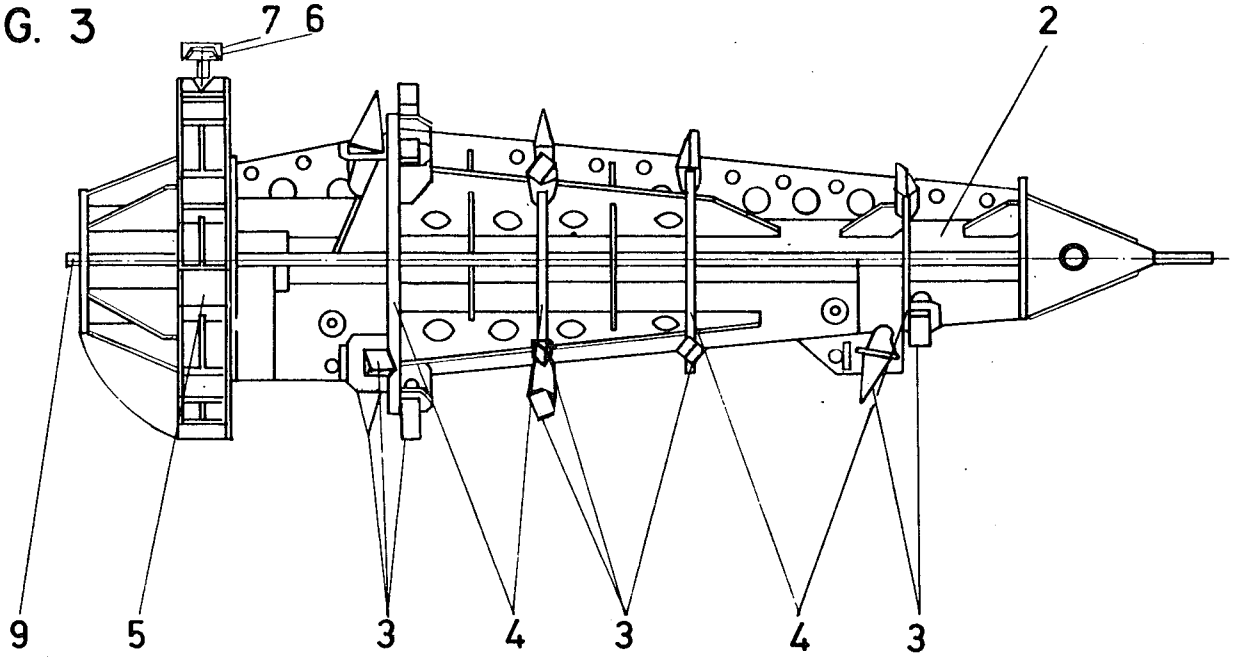
FIG. 3 is a side elevational view of the break off roller of the present invention.

FIGS. 1, 2 and 3 show a part of a horizontal rotary kiln of practically any desirable length and desirable diameter which, by utilization of its own rotary drive mechanism, is freed from deposits and the refractory lining. A break off roller 1 is utilized for this purpose. Suitably cutting discs 4 are arranged according to size and provided with replaceable cutting teeth 3 as well as roll-off teeth 3', that are arranged along the central guiding rod 2, provide for the conical mantle shape of the device in the area of the guiding rod. If desired, in a different embodiment of the inventon the conical end of the break off roller can be omitted, and the cutting disc can be provided with its teeth arranged in identical pairs (not shown). As the rotary kiln turns, the break off roller 1 moves with it in a double motion. On the one hand, this comprises a rolling rotation in which the cutting teeth 3 of the cutting discs 4 rhythmically impact in the instantaneous bottom portion of the rotating kiln onto the deposit and the masonry lining while also cutting into their surfaces, and on the other hand, in a longitudinal movement due to the conical mantle shape, which movement is in the direction of the pointed end of the break off roller 1. This longitudinal motion overcomes the slight angular changes due to the inclination of the rotary kiln as well as the unevenness of the deposit therein. In other words, the break off roller both rotates and climbs within the rotary kiln as the latter is rotated. As shown in FIG. 2*a*, in a working position in the rotary kiln 10 the break off roller 1 has its central axis disposed at an angle, relative to the longitudinal axis of the rotary kiln. The longitudinal motion of the break off roller 1 can be regulated by retarding that motion through a cable 9 attached to its rear end. The other end of the cable is attached to a winch 8 which is outside of the rotary kiln. The winch 8 enables both a retarding of the forward motion of the break off roller as well as it stopping it entirely. The winch 8 can be any suitable cable winding mechanism such as a drum and equipped with suitable controls known per se.

Figure 2B:
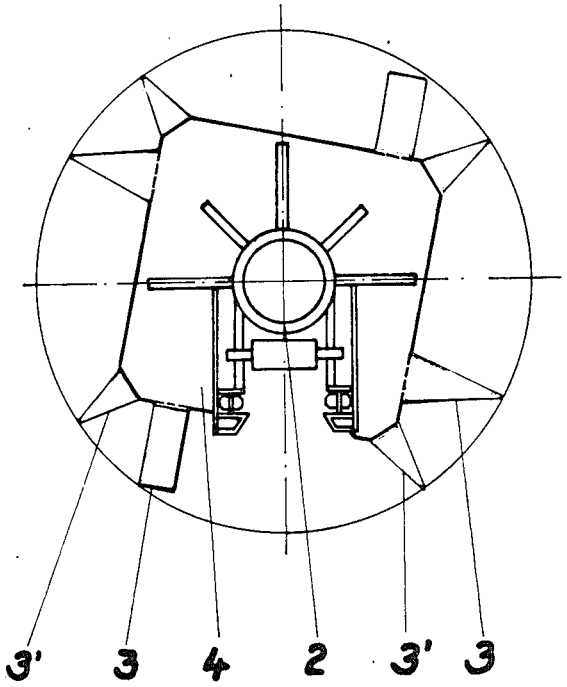
FIG. 2*b* is a schematic, vertical sectional view of a cutting disc having cutting teeth and roll off teeth, viewed from the conical end of the break off roller.
Figure 2C:
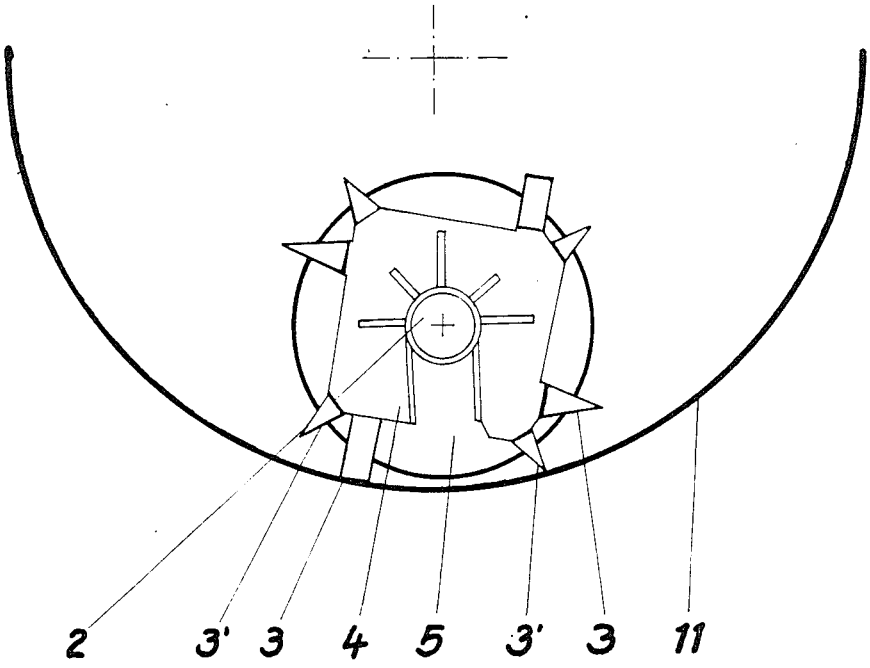
FIG. 2*c* is a schematic vertical view of the cutting disc of FIG. 2*b*, in the rotary kiln, with a stabilizing disc indicated behind it.

FIGS. 2*b* and 2*c* illustrate the relative positions of the cutting teeth 3 and the roll off teeth 3' and the arrangement of the tips of the teeth in a circle of identical center points. Here the selected pairing of the cutting teeth 3 and roll off teeth 3' shows the supporting function of the roll off teeth 3' when the break off roller 1 reaches its maximum elevated position on the walls of the rotary kiln until rolling down again to or towards the bottom of the rotary kiln 10. In FIG. 2*c* the break off roller 1 is shown in its desired position in the rotary kiln, whereby the stabilizing disc 5 can be seen in this view behind the cutting disc 4. The adjusting elements 6 of the stabilizing roller are functioning. It is in this position that most effective operation can be achieved. The cutting disc 4 is disposed on the work surface with a cutting tooth 3 and a roll-off tooth 3' of the lower pair of teeth. When during the counterclockwise rotation of the kiln, the break off roller 1 rolls down counterclockwise and impacts upon the work surface, from its maximum elevated position, the roll off tooth 3' of the rear, lower pair of teeth rests on the furnace deposit, and the left upper cutting tooth impacts downwardly. If the severity of the impact should be ameliorated, and the effect should be converted into a more uniform rolling that shakes the deposit 13, then FIG. 2*c* shows a possibility by adjusting the stabilizing disc 5 which with adjusting elements 6 closely approaching with their contact point the furnace deposit surface and the roll off teeth 3'.

Figure 4:
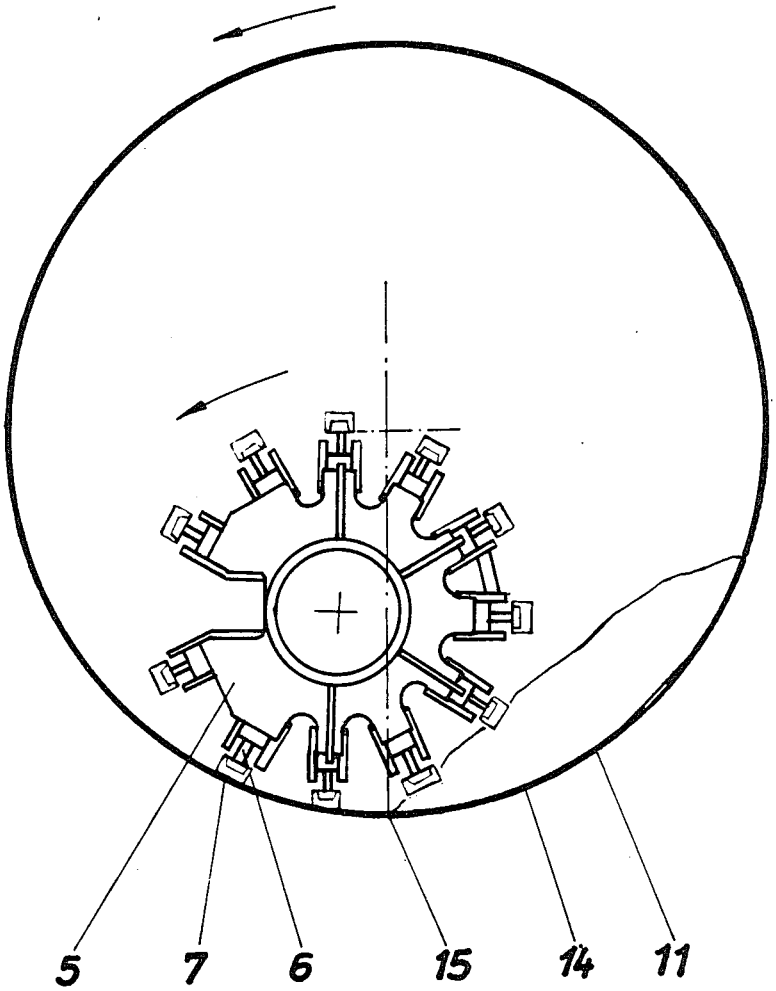
FIG. 4 is a schematic front elevation of the apparatus of the present invention with the stabilizing disc, within a schematic transverse cross-section of rotary kiln.

As is shown in FIG. 2, the removal process takes place essentially in two phases. In the first phase, the break off roller 1 shakes and loosens the interior layers by means of steady impact of the cutting teeth so that the arch structure becomes so loosened that in the second phase during constant rotation the loose pieces become increasingly looser and then can fall down when the loose piece reaches a top position during rotation. If the stabilizing disc 5 is mounted at the rear end of the break off roller 1, as is shown best in FIG. 4, 2 and 2*c*, the stabilizing disc causes the rear part of the break off disc 1 to lie outside the lowest point 15 of the cross section 11 of the rotary kiln. As the break off roller 1 moves due to the rotary motion of the rotary kiln 10, during the break off process the following effects are produced: (a) the break off roller 1 moves, as shown in FIG. 4, relatively independently and outside of the flow 14 of broken off material that moves against it, whereby the resistance toward forward motion is minimized; and (b) the arrangement of the stabilizing disc 5 as shown in FIGS. 3 and 4 enables the forward movement of the break off roller 1 in the direction of its pointed end even in those portions of the rotary kiln where the deposit and the refractory wall were removed and only a bare kiln surface is exposed.

The stabilizing disc 5 is provided at its periphery with a number of radial adjusting elements 6 which are provided at their outer ends with contact elements 7. These are uniformly distributed throughout the periphery of the stabilizing disc 5. According to the adjusted length of the radial adjusting element 6, the effective diameter of the stabilizing disc can be adjusted to regulate the motion and characteristics of the break off roller 1. The striking or bite depth of the cutting teeth 3 as well as the magnitude of their impact can be adjusted by changing the effective diameter of the stabilizing disc 5 by means of the radial adjusting elements 6. Furthermore, the nature of the motion of the break off roller can be changed in the same manner from a noisy rhymthmical impact in the case of smaller stabilizing disc 5 diameters to a more calm rolling when the diameter of the stabilizing disc 5 is adjusted to a larger size. In this manner, it is possible to minimize any damage that could be caused by cutting teeth 3 to exposed steel wall surfaces of the rotary kiln 10 or to intact parts of the refractory lining 12 that are to be retained. This kind of adjustment, of course, permits that the break off roller be set only for removing the deposits 13 separately, without damaging the furnace lining.

Suitably in carrying out the process of the present invention, the axial distance of the stabilizing disc 5 from the first, the largest cutting disc 4, is greater than the size of a stone or even its multiple. When the adjusting elements of the stabilizing disc are fully extended, then the position of the break off roller 1 is changed to the extent that the roll off teeth 3' become lifted out from their operational function and the break off roller will tilt towards its pointed end. In this position the larger end of the break off roller 1 is supported to a greater extent by the stabilizing disc. The further the adjusting elements of the stabilizing disc are extended, the less the penetration of the cutting teeth into the deposit and kiln lining to be removed. The impact intensity and removal results of the larger cutting discs is reduced and the weight is displaced increasingly towards the smaller cutting discs towards the pointed end of the break off roller 1.

These cutting discs 4 require less energy due to their geometric shape and their arrangement on the break off roller. It is an advantageous feature of the present invention that due to the geometric relationships the break off roller that is adjusted to the conditions of the rotary kiln, will necessarily move along with the moving rotary kiln into which it was introduced. There, due to its own mass and the exchangeable working tools attached to it, it will break out the kiln wall deposits and the kiln walls, as may be required, due to light impact, pushing and tearing forces. Thus, according to the particular circumstances, the break off roller can be constructed to have suitable mass, and can be articulated, hollow, or variable in its mass, size, number of working tooling and of desired cross section. Independently of such variables, the break off roller has a conical shape which when inserted into a rotating rotary kiln, will move in the direction of its pointed end. At its rear end the break off roller is attached through a rope connection to a winch. Functionally dependent from the use of the winch, the conical shape of the break off roller guides in a longitudinal and rolling motion that overcomes the longitudinal tilt of the rotary kiln. The winch enables the breaking, slowing or even reversing the movement of the break off roller in the longitudinal direction. The break off roller can, by utilizing the rotating drive of the rotary kiln, cover the entire inner cylindrical surface of the kiln. The cross sectional shape of the break off roller has a pronounced influence on the operating characteristics of the break off roller. Thus an angular roller cross section will exert during its rotation advantageously rhytmic impacts of increased force. Furthermore, a break off roller of angular construction can elevate itself from the bottom of the rotary kiln and thus from time to time free itself from the flow of loose, broken out matter. The effect of the break off roller during the constant rotation of the rotary kiln, is substantially amplified by the fact that the shaken and loosened deposit in the rotary kiln, as well as its lining, lose their arch structure under the constant pounding and shaking and will collapse under its own weight when the kiln rotation brings it into a hanging, upper position. The size and outer effective diameter of the stabilizing disc has to be adjusted according to the shape and size of the break off roller. The disc stabilizes the operation of the break off roller and its positioning in the direction of its pointed end. This especially so, when tbe break off roller moves along the inner surface of the rotary kiln which is already free from its lining and any deposits thereon. Therefore, the stabilizing disc can be constructed as compact or adjustably articulated, and can be of various mass, position, or material. It can be recognized that the stabilizing disc enables the break off roller to assume a position which enables that the operation of the roller is not unduly influenced by the main flow of the broken out particles.

When the movement of the break off roller 1 is controlled on an exposed steel wall against a flow 14 broken off material, the radial adjusting elements are set so that, as shown in FIG. 3, the cutting teeth 3 are lifted between the pointed end of the break off roller 1 and the stabilizing disc 5. Thus, the main load rests on the stabilizing disc 5, due to the shape of the break off roller 1. The contact elements 7 should be made of a material which has a suitable contact attachment properties to adjacent surfaces as well as good wear characteristics, such as rough casting or hard rubber. This can contribute substantially to the movement characteristics of the break off roller 1 at various tilt angles of the rotary kiln and stabilized against the flow 14 of broken off material.

When the direction of rotation is chosen to be counterclockwise, then the break off roller 1 moves to its maximum elevation within the rotary kiln, until the center of gravity of the roller becomes labile and the roller tilts counterclockwise towards the bottom of the kiln. Since the roller has a conical form in this preferred embodiment, its rolling down or tilting distances of the cutting discs 4 are longer at the larger end than at the smaller one. This results in the longitudinal axis of the roller assuming a tilted position, with respect to the longitudinal axis of the rotary kiln which is constantly rotating. This movement of the break off roller from the bottom of the kiln to a maximum vertical elevation and back, is continuously repeated due to the continuous rotation of the rotary kiln. At the pointed tip, the roller describes a pendulous motion with the axial position of the roller relative to the axis of the kiln. This pendulous motion is obtained by the fact that the length of the break off roller is generally larger than the diameter of the rotary kiln. In this procedure the deposit is removed separately, partially or totally, until the furnace lining becomes exposed, and when required, also the lining is removed.

The break off roller 1 is made as a robust, preferably conically-tipped, cylindrical body, having sufficient mass and size, provided with teeth, so that it is set to passive rotation by and within a rotary kiln that is rotated about its longitudinal axis. This rotary motion is converted by an advantageously polygonal cross-sectional structure of the body of the break off roller 1, into rhytmic impacting of the break off roller onto the surface on which it rotates, whereby the teeth 3 and 3' will manhandle the deposit layer 13 and the furnace lining 12 and cause them to collapse through destruction of the arch structure. The conical construction of the break off roller assists in it achieving a slight inclination relative to the longitudinal axis of the rotary kiln and this divides the relative movements of the break off roller into two main components.

One of the components of movement of the break off roller is vertical to the longitudinal axis of the rotary kiln. When the movement is not impeded, then the seoond component of movement of the break off roller, is parallel to the longitudinal axis of the rotary kiln. When the winch 8 is subjected to a retarding breaking, then the second component of movement changes to a varying longitudinal force, the magnitude of which depends from the weight and total geometry of the body of the break off roller 1, the rotating motion and the inclination of the rotary kiln, as well as especially from the frictional force between the break off roller and the working surface it is disposed on, and also from the deposit 13 on, and lining 12 on, the interior wall of the kiln.

A further resultant component of movement occurs during the unhindered movement of the break off roller 1 in the rotary kiln 10. This component has a spiral direction.

Due to the aforementioned second component of movement, break off rollers can overcome upward inclinations of rotary kilns. Thereby it is possible to insert the break off roller into the open rear end of a rotary kiln, by the conical tip of the roller facing in the forward direction, and then conducting the removal operation against the inclination of the rotary kiln.

The flow of broken out particles created during the break off operation, is continuously removed in the direction of the inclination of the rotary kiln, by means of the continuous rotation thereof. During this, the break off roller 1 moves during the guided working phase as much as possible in front of the flow of broken out particles. The method of manufacture of the material, the size, and the cutting edge of the tool can vastly differ while the principle of operation of the break off roller remain unchanged. Suitably, the body of the break off roller 1 is made of a conical, robust and strongly articulated apparatus which is provided with replaceable break off teeth 3, the stabilizing disc 5 having radially adjustable elements, building elements that are based in a protected manner, such as spring hanger, a universal coupling (not shown), and a winch 9. The stabilizing disc 5 is mounted from the end of the break off roller opposite to its conical end, and is firmly attached to the roller. The transmission of forces takes place over robust, cylindrical bosses to enable taking up of the strong pushing and impact forces in the connection between the stabilizing disc, the body of the roller and the cutting disc 4. These bosses are protrudingly welded to a stable flange disc (not shown) of the roller body, and range in a locking relationship into mating circular cavities on a flange disc. Connecting screws (not shown) are inserted into the cylindrical bosses for establishing the connection. The cylindrical bosses essentially take up the impact and pushing forces. The sizes and shapes of the cutting disc 4, the stabilizing disc 5 and the roller body are functionally harmonized with each other. The roller body is connected with the replaceable cutting teeth 3 of different size, for the breaking out process, while the stabilizing disc has a stabilizing and supplemental complementary function which can be advantageously employed for the technologically advantageous guidance of the working and movement relations of the break off roller. The construction of the break off roller 1 involves a central, thick walled tube having stable mainly radially arranged longitudinal ribs (not shown) welded on to it, and generally four cutting discs 4 with teeth, which discs are varied in size and strength.

At least on cutting disc 4 has a square shape and is provided with a variety of suitably replaceable cutting teeth 3 of various shapes and positions. The cutting disc is disposed on the central guiding rod 2 outside of the center of gravity of the break off roller, between its conical end and the attached cable 9. The cutting teeth 3 rotate along circular paths. Advantageously the cutting teeth 3 are mounted in pairs, the constituent teeth of which are of equal size within each pair. Suitably at least four cutting teeth have the same size. Most suitably, the tips of the cutting teeth 3 and the roll off teeth 3' form a square shaped cutting disc and the squares formed from the various tips of the teeth are offset with respect to each other in a manner that an irregular octagon is formed. The cross sectional shape of the break off roller 1 determines its effectiveness and its motion characteristics. Thus, a roller cross section which is suitably provided with corners provides rhymthmical impacts during rotation and this significantly increases the destructive effect. Furthermore, in the case of a cross section with corners, the break off roller can move out from a bottom position in the cylinder and thus constantly free itself anew from a flow of particulate removed material. The effect of the break off cylinder during the continuous rotation of the rotary kiln can be decisively amplified due to the fact that the deposit, and if desired the furnace lining, which has been shaken and loosened by the break off roller, will lose its circular arch structure and due to its own weight will collapse as the break off roller 1 moves during the rotation to a maximum elevation and then rolls back with an impact.

It is preferable that in all cases four cutting teeth 3 have the same size. The shape of the cutting discs includes the feature that the cutting teeth 3 are larger than the roll off teeth 3'. They are arranged in pairs relative to each other. The roll off teeth have a supporting function which influences the movement of the break off roller 1. This influence is achieved through the fact that the roll off teeth 3' are in a geometrical relationship with the stabilizing disc 5 which cannot become snagged when these teeth are in operation.

A small distance between cutting teeth 3 and the roll off teeth 3' results in the case of a small distance, to a rolling off movement of the break off roller, and when the distance is large, then to an impacting of the teeth. This means that the cutting tooth will impact on the bottom of the kiln as the break off roller 1 rolls back onto it.

According to another embodiment of the invention, the wedge shaped cutting teeth are arranged on at least two cutting discs 4, and the wedges of several of the cutting teeth are disposed at a right angle to the longitudinal axis of the break off roller 1. In this case, the cutting teeth 3, during the movement of the break off roller in the rotary kiln, are perpendicular to the inside of the rotary kiln and, in relation to the transverse axis, they are arranged also to coincide with the longitudinal axis.

A common feature of each cutting disc 4 is that the teeth 3 and 3' attached thereto, are arranged with their tips along a circular path, concentricaly with the central axis of the roller. The relative distances of the cutting discs 4, the sizes of the aforementioned circular paths of the tips of the teeth, as well as the distribution and alignment of the teeth 3 and 3' are to be made according to functional requirements.

The operation of the break off roller 1 can be influenced by the arrangement of the cutting discs 4 and the teeth 3 and 3' as well as of the stabilizing disc 5 as follows. The principal breaking off action of the break off roller 1 is oriented towards the largest, the rearmost cutting disc 4. This results on one hand from the position of the center of gravity, the impact lever arm of the cutting disc 4 and its teeth, and on the other hand, from the conical nature of the body of the break off roller. It is possible that all teeth on all cutting discs 4 are biting into the deposit under the break off roller, placing a bigger load on the drive, with the result that the teeth dig deeper into the deposit and this results in their breaking off more therefrom. By the use of the stabilizing disc 5 all cutting teeth are bridged over and a smoother running of the break off roller can be achieved. The use of the stabilizing disc improves the movement over the base metal surface. By means of the bridging over of the cutting teeth, no or only small impacts are made onto the metal surface. Thus, the metal surface of the interior of the rotary kiln and the cutting teeth can be better protected against undue wear. It is a significant fact that the movement of the break off roller 1 on the bare metal surface, in one of its settings, without the use of the stabilizing disc, is entirely different from its normal operating movement. The considerable reduction of the frictional forces between the break off roller and the bare metal surface in comparison to movement over the deposit in the rotary kiln 10, results in that, in spite of the rotation of the rotary kiln, the break off roller hardly rotates therein. Thus the principal vertical output forces in the rotary kiln 10 are supported to a greater extent by the flow of removed matter 14, than the longitudinal motion components of the break off roller 1 in the direction of its pointed end, and the break off roller, therefore, moves in an uncontrolled fashion in the direction of the rear end of the rotary kiln. The break off roller can be properly adjusted by the use of the stabilizing disc and the possibility of its radial enlargement.

A smooth rollable cross section can be achieved through eleven radially adjustable polygon points that are approximately uniformly distributed over the periphery of the stabilizing disc 5, in contrast to the irregular octagon of the cutting disc 4. This rollable cross section is disposed generally to the side, away from the flow of broken off matter 14. In the case that it becomes necessary to increase the friction between the stabilizing disc 5 and the metal hull of the rotary kiln 10, the radial adjusting elements 6 of the stabilizing disc 5 can be temporarily tipped with contact elements 7, or the adjusting elements 6 can be provided in the contact range, with suitable metals or metal alloys which have a more favorable, i.e. higher coefficient of friction vis a vis steel.

The arrangement of the teeth 3, 3' on both smaller cutting discs 4 depends geometrically from the arrangement of the larger cutting discs 4. While the teeth 3 of both larger cutting discs 4 do the actual breaking out of matter, the teeth 3 of the two smaller cutting discs 4 essentially serve to assure a sufficient bite of the break off roller 1 in the deposit 13 and the lining 12 and in the central part of the roller 1. The first cutting disc 4, as shown in FIG. 2*b* of the preferred embodiment, is provided with four larger cutting teeth 3 as well as four smaller roll off teeth 3'. As further shown in FIG. 2*b*, the four large brak off teeth 3 are attached on alternate sides of the disc. This means that two teeth 3 are mounted with their wedges parallel, and two others with their wedges perpendicular, to the longitudinal axis of the break off roller 1. The arrangement of the teeth with their wedge perpendicular to the longitudinal axis of the break off roller 1, wear off the deposit and serve to tear up the arch of the kiln lining, primarily at the starting area of the process, and behind bracings. In contrast, the tooth arrangement wherein the wedge is parallel to the longitudinal axis of the rotary kiln 10, serves primarily for carrying on the break out process in the longitudinal direction of the rotary kiln. The teeth 3 pry apart the rings of the arch of the furnace lining in the direction of the longitudinal axis of the rotary kiln, and this leads to their rapid collapse when the impact takes place near to the breaking joint.

In addition to the nature of the material of the deposit, the precise orientation of the four breaking off teeth 3 is important for determining their useful life. This requires that when the cylindrical roller body is tilted, the teeth 3 should meet the surface of the deposit as perpendicularly as possible. The need for the four smaller roll off teeth 3' can be demonstrated from their geometrical relationship to the stabilizing disc 5. The roll off tooth 3' serves to lift the entire roller body, especially in the region of the stabilizing disc 5. This allows the realization of the full impact strength of the teeth 3, without an intermediate impact or rolling of the stabilizing disc 5 in any working position of the break off roller 1. The second cutting disc 4 has, as the first disc, eight teeth which are arranged on the second disc in a manner similar to the first disc. Break off, and roll off teeth 3 and 3' are here of the same size as the roll off teeth 3' of the first disc 4, due to the reduced effect. In contrast to the first cutting disc 4, four break off teeth 3 are arranged with their wedges being parallel to the longitudinal axis of the break off roller 1, to support and ease the breakout process by the cutting disc primarily in the direction of the longitudinal axis of the kiln. The roll off teeth 3' are, in this embodiment, embedded in the plane of the second cutting disc 4, and are turned about 45° with respect to the longitudinal axis.

The insertion of the break off roller 1 is concluded when its rear end ranges into the rotary kiln 10 at least to a depth of 0.5 to 1 meters. The starting speed of rotation of the rotary kiln 10 should be adjusted according to working experience, layer thickness to be removed and the amount of loose matter in the kiln. The deposit 13 should be removed first, at least to a full length of the break off roller 1, before attempting to remove the first ring of the furnace lining arch. In the case of break off roller insertions when the furnace is hot, before the insertion of the break off roller 1 into the rotary kiln 10, a possibly fat free and hemp free rope, with thimbles on both sides and of about 10 meter length, should be attached to the hook on the break off roller so that the free end of the rope will be outside the rotary kiln and its immediate hot vicinity, so that it can be connected to the rope of the winch. The breaking out of the first rings of the furnace lining arch takes place usually when the forward movement of the break off roller 1 is slowed down by means of the rope, since the lining at this point is usually under strong tension, especially towards the longitudinal direction of the kiln. In this phase of the operation, the first cutting disc 4 of the break off roller 1 is to be run in a floating manner for about 0.2 to about 1 meter before the rear edge of the rotary kiln 10, until that range is lightly worked over. When the break out roller 1 is subsequently operated at the rear end of the rotary kiln 10, it should not be able to be displaced by the flow of loose broken material. Only when the break out roller operates with controlled movements, should the initial speed of the rotary kiln be increased. When the first three or four rings of the furnace wall lining 12 to the next supporting ring are completely broken out, then the guidance of the break out roller 1 should be adjusted for a strongly accelerated breaking out.

What is claimed is:

1. An apparatus for the removal of deposits from and/or linings of rotary kilns that have a substantially horizontally disposed longitudinal axis, comprising a partially substantially conically shaped break off roller adapted to be placed into the interior of a rotary kiln for rolling upon the interior surface and having means for moving forward within, said rotary kiln solely due to the rotation of said rotary kiln, said break off roller having a larger end and a smaller end, and further having elongated guiding means for the disposition and guidance of further means thereabout, cutting means for cutting and crushing matter to be removed from within the rotary kiln, and disc means disposed about said elongated guiding means for mounting said cutting means from the periphery of said disc means.

2. An apparatus according to claim 1, further comprising stabilizing means disposed at the larger end of said at least partially conical break off roller for stabilizing and supporting said break off roller within the rotary kiln, said disc means being disposed on said elongated guiding means off center with respect to the longitudinal axis of the break off roller.

3. An apparatus according to claim 1, further comprising means for retarding, stopping and/or reversing the motion in an axial direction of the break off roller.

4. An apparatus according to claim 2, wherein said stabilizing means is provided with peripheral means for altering the effective rotary diameter of said stabilizing means.

5. An apparatus according to claim 1, wherein said disc means comprises a plurality of substantially square shaped discs disposed rotationally offset relative to each other about said elongated guiding means.

6. An apparatus according to claim 5, wherein the offset position of the plurality of discs forms an irregular octagon.

7. An apparatus according to claim 4, wherein the means for radially altering the effective rotational diameter of said stabilizing means is provided with contact elements at its radially outer end.

* * * * *